US005412405A

United States Patent [19]

Nureki et al.

[11] Patent Number: 5,412,405

[45] Date of Patent: May 2, 1995

[54] LINE THERMAL PRINTER HAVING POWER SUPPLY CAPACITY MATCHED TO NUMBER OF PRINTING DOTS

[75] Inventors: Shinji Nureki; Kazuhisa Oonishi, both of Tokyo, Japan

[73] Assignee: Seiko Instruments Inc., Japan

[21] Appl. No.: 670,293

[22] Filed: Mar. 15, 1991

[30] Foreign Application Priority Data

Mar. 16, 1990 [JP] Japan ..... 2-67863

[51] Int. Cl.[6] ..... B41J 2/36

[52] U.S. Cl. ..... 347/182

[58] Field of Search ..... 346/76 PH, 1.1; 400/120

[56] References Cited

U.S. PATENT DOCUMENTS

| | | | |
|---|---|---|---|
| 4,216,481 | 8/1980 | Hakoyama | 346/76 PH |
| 4,447,819 | 5/1984 | Moriguchi et al. | 346/76 PH |
| 4,638,329 | 1/1987 | Nakayama et al. | 346/76 PH |
| 4,731,618 | 3/1988 | Shimazaki | 346/1.1 |
| 4,738,553 | 4/1988 | Uemura et al. | 346/76 PH |
| 4,875,056 | 10/1989 | Ono | 346/76 PH |

FOREIGN PATENT DOCUMENTS

| | | | |
|---|---|---|---|
| 0044371 | 3/1985 | Japan | 346/76 PH |
| 0074662 | 4/1988 | Japan | 346/76 PH |

*Primary Examiner*—Benjamin R. Fuller
*Assistant Examiner*—N. Le
*Attorney, Agent, or Firm*—Bruce L. Adams; Van C. Wilks

[57] ABSTRACT

A line thermal printer has a line thermal head comprised of a plurality of physical blocks arranged in a line. Each physical block has a plurality of heat generation elements to which power is selectively supplied for dot printing a line. A driving circuit has driving blocks corresponding to the physical blocks and selectively supplies power to the heat generation elements line-by-line in line sequence in accordance with the printing dot data. Printing dot data memory blocks are connected to corresponding ones of the driving blocks and supply the printing dot data to the driving circuit in synchronism in line sequence timing. A printing dot counter has counter blocks connected to corresponding ones of the printing dot data memory blocks and counts the printing dot number on the basis of the printing dot data held in the memory blocks for each line of print. A control circuit is connected between the printing dot counter and the driving circuit and forms logic blocks by combining a plurality of physical blocks on the basis of the printing dot number counted by each counter block within a range which does not exceed a predetermined maximum allowable number of heat generation elements which can be supplied with power.

14 Claims, 3 Drawing Sheets

FIG. 3A

| | | | | |
|---|---|---|---|---|
| FIRST PHYSICAL BLOCK | SECOND PHYSICAL BLOCK | THIRD PHYSICAL BLOCK | FOURTH PHYSICAL BLOCK | FIFTH PHYSICAL BLOCK |

FIG. 3B

| | | | | |
|---|---|---|---|---|
| 64 DOT | 64 DOT | 64 DOT | 64 DOT | 64 DOT |

TOTAL 320DOT
N = 128DOT

FIG. 3C

| | | | | |
|---|---|---|---|---|
| FIRST PHYSICAL BLOCK | SECOND PHYSICAL BLOCK | THIRD PHYSICAL BLOCK | FOURTH PHYSICAL BLOCK | FIFTH PHYSICAL BLOCK |

128DOT FIRST LOGIC BLOCK | 128DOT SECOND LOGIC BLOCK | 64DOT THIRD LOGIC BLOCK

FIG. 3D

| | | | | |
|---|---|---|---|---|
| 20 DOT | 40 DOT | 10 DOT | 60 DOT | 60 DOT |

FIG. 3E

| | | | | |
|---|---|---|---|---|
| FIRST PHYSICAL BLOCK | SECOND PHYSICAL BLOCK | THIRD PHYSICAL BLOCK | FOURTH PHYSICAL BLOCK | FIFTH PHYSICAL BLOCK |

80 DOT FIRST LOGIC BLOCK | 120 DOT SECOND LOGIC BLOCK

LINE THERMAL PRINTER HAVING POWER SUPPLY CAPACITY MATCHED TO NUMBER OF PRINTING DOTS

BACKGROUND OF THE INVENTION

This invention relates to a line thermal printer, and more particularly to power supply control technology of a line thermal head the number of printing dots.

A line thermal printer includes generally a line thermal head having a plurality of heat generation elements that are arranged on a line. Dots are printed by driving selectively a plurality of heat generation elements in line sequence for each line on the basis of printing dot data representing image data. Conventionally, power is supplied simultaneously to selected heat generation elements and dot printing is made in line sequence irrespective of the printing dot number for each line.

BRIEF SUMMARY OF THE INVENTION

The number of printing dots for each line changes greatly in accordance with image data. In a conventional line thermal printer, therefore, the capacity of a current supply source is set in accordance with the capacity necessary when power is supplied simultaneously to all the heat generation elements. This arrangement has the drawbacks that the current capacity is set to be considerably greater than a mean current quantity consumed for printing line-by-line in line sequence and the utilization efficiency of the power source is low. Since a power source having an excessively greater current capacity in comparison with the printing capacity of the line thermal printer must be used, there is another problem that a great limitation is imposed on setting of the power source capacity.

BRIEF DESCRIPTION OF THE DRAWINGS

FIG. 3A–3E are schematic views useful for explaining the function of the line thermal printer.

DETAILED DESCRIPTION OF THE INVENTIONS

Figure 1:
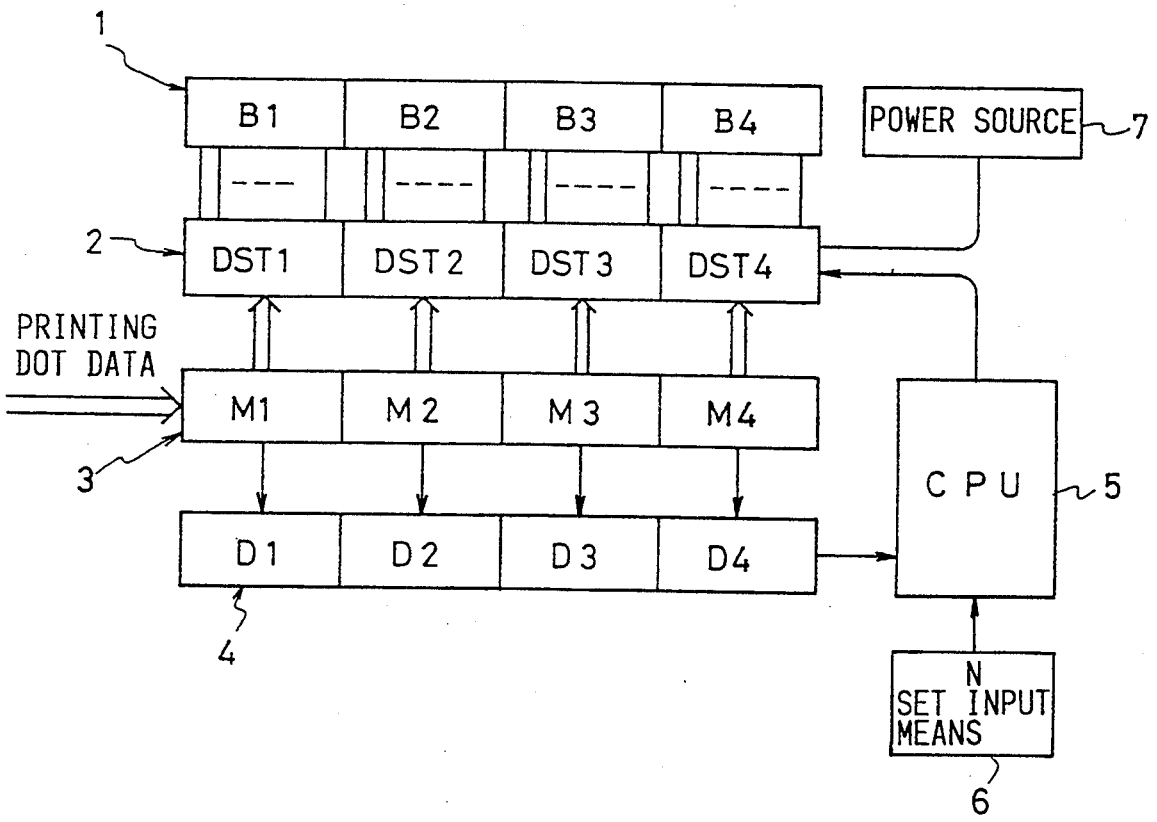
FIG. 1 is a circuit block diagram showing an embodiment of a line thermal printer.

FIG. 1 is a schematic circuit diagram showing an embodiment of a line thermal printer in accordance with the present invention. As shown in the drawing, the line thermal printer includes a line thermal head 1. The line thermal head 1 has physical blocks B1, B2, B3, B4 that are divided into four blocks in a line direction. Each block B has a predetermined number of heat generation elements to which power is applied selectively for effecting dot printing on a line. A driving circuit 2 is connected to the line thermal head 1. The driving circuit 2 has four driving blocks DST1, DST2, DST3, DST4 that are divided in such a manner as to correspond to the physical blocks B, respectively. Each driving block DST selectively applies power to the heat generation elements contained in the physical block corresponding thereto in line sequence for each line in accordance with printing dot data allocated thereto.

A printing dot data memory 3 is connected to the driving circuit 2. The printing dot data memory 3 supplies printing dot data to the driving circuit 2 in synchronism with a line engagement timing. The printing dot data memory 3 has four memory blocks M1, M2, M3, M4 that are divided in such a manner as to correspond to the driving blocks, respectively. Each memory block M supplies the allocated printing dot data to the corresponding driving block DST. A printing dot counter 4 is connected to the printing dot data memory 3. The printing dot counter 4 has four counter blocks D1, D2, D3, D4 that are divided in such a manner as to correspond to the memory blocks of the printing dot data memory 3, respectively. Each counter block D reads the printing dot data held by the corresponding memory block M and counts the printing dot number in synchronism with line sequence timing for each line. This printing dot number represents the number of the heat generation elements to which power is applied practically in the corresponding physical block B.

Control means comprising a CPU 5, for example, is connected between the printing dot counter 4 and the driving circuit 2. The CPU 5 combines a plurality of physical blocks B and forms a logic block on the basis of the printing dot number countered by each counter block D within the range which does not exceed a maximum allowable number of simultaneous power supply of heat generation elements that is determined in advance. Furthermore, the CPU 5 controls the driving circuit 2, lets it supply power to the heat generation elements dividedly in accordance with the logic block that is formed logically, and executes one line sequence dot printing. Set input means 6 comprising a keyboard, for example, is connected to the CPU 5, and sets and inputs a predetermined maximum allowable number N of heat generating elements which can simultaneously be supplied with electric power based on the capacity of the power supply. A power source 7 is connected to the driving circuit 2 and supplies a current for each line sequence printing to the driving circuit 2. The power source 7 has a current capacity which is in match with the maximum allowable number N of simultaneous power supply which is set by the set input means 6. Since a power source having a desired capacity can be used in accordance with the number N which is set appropriately, a suitable power source can be selected economically.

Figure 2:
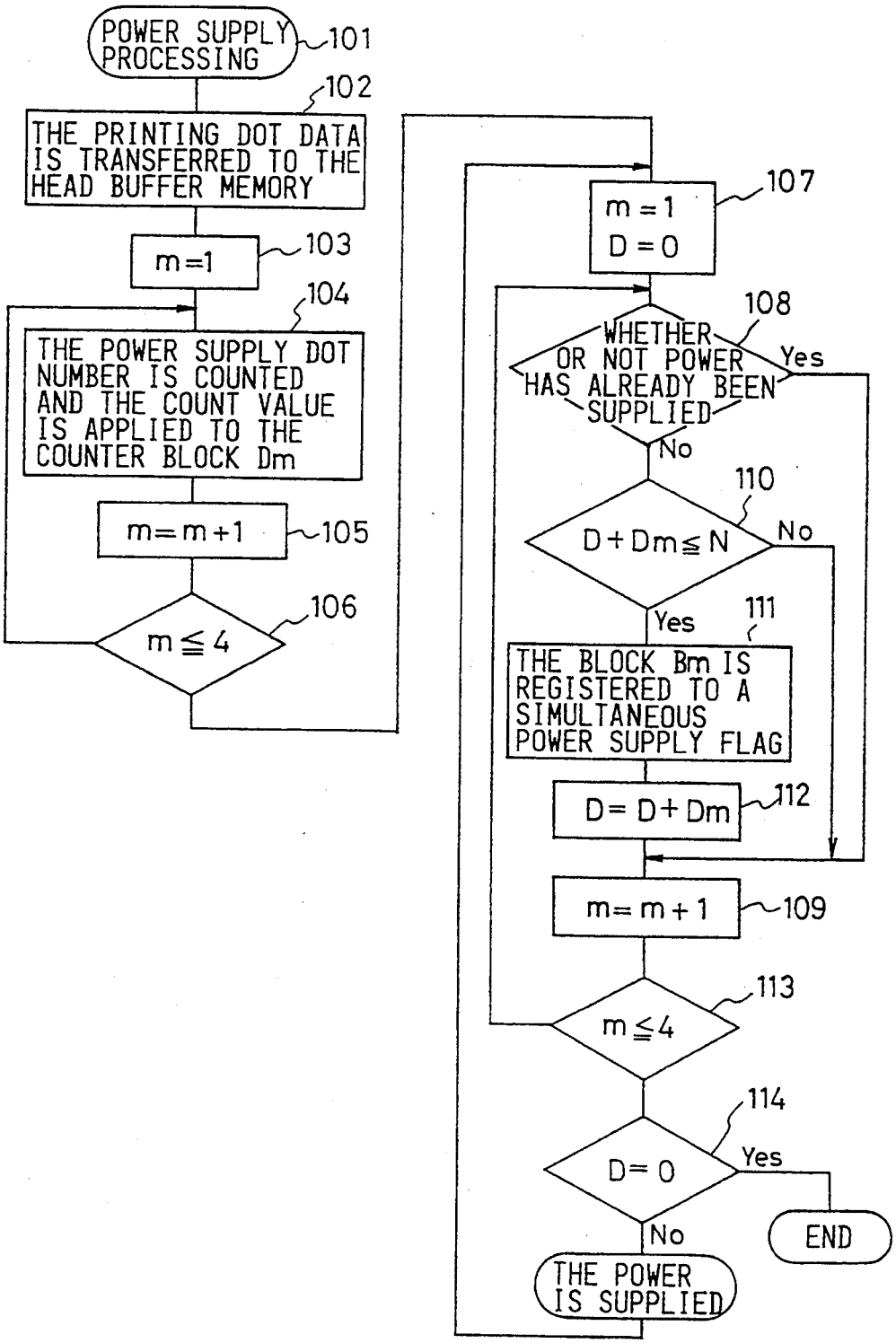
FIG. 2 is a flowchart useful for explaining the operation of the line thermal printer.

Next, the operation will be explained in detail with reference to the flowchart shown in FIG. 2. To begin with, an execution command of one line sequence dot printing or power supply processing is given from an external host computer to the CPU 5 at Step 101. The printing dot data per line, that is sent from the host computer, is transferred to the printing dot data memory 3 or to the head buffer memory at Step 102. An index m is set to 1 at Step 103. This index m represents the number of the physical blocks of the line thermal head and can take the numbers of from 1 to 4. At the next Step 104, the number of printing dot data given to the mth physical block Bm designated by the index m or in other words, the power supply dot number, is counted and the count value is applied to the corresponding counter block Dm. The index m is incremented at Step 105 and whether or not the index m exceeds 4 is judged at Step 106. Count of the power supply dot number of each physical block is repeated until the index m exceeds 4.

After the counting operation is completed four times, the index m is set to 1 at Step 107 and a variable D is set to 0. Next, whether or not power has already been supplied to the physical block Bm designated by the index m is judged at Step 108. If power has already been supplied to the physical block Bm, the flow proceeds to Step 109, where the index m is incremented. If power has not yet been supplied to the physical block Bm, the flow proceeds to Step 110. Whether or not the sum of the variable D and the count value Dm for the physical block Bm is greater than a predetermined maximum allowable number N of simultaneous power supply is judged at Step 110. If it is greater, the flow proceeds to Step 109, where the index m is incremented. If it is not, the flow proceeds to Step 111, where the physical block Bm is registered to a simultaneous power supply flag. Then in Step 112, the variable D is updated by adding the count value Dm to the variable D. Thereafter, the flow proceeds to Step 109 and the index m is incremented. Whether or not the index m exceeds 4 is judged at Step 113. The registration operation to the simultaneous power supply flag described above is repeated until the index m exceeds 4. When the index m is judged as exceeding 4 at Step 113, the flow proceeds to Step 114. Whether or not the variable D is 0 is judged at this step. If the variable D is 0, the supply of power to all the physical blocks is judged as being completed and the program finishes. If the variable D is not 0, on the other hand, the flow proceeds to Step 115 and power is supplied to the combination of the physical blocks registered to the simultaneous power supply flag, that is, to the logic block. After the power is supplied, the flow returns again to Step 107 and the preparation of the logic block described above and the supply of power are repeated. The program is completed at the point where the variable D is 0 at Step 114.

Next, the function and operation of the present invention will be explained briefly. It will be assumed that the line thermal head has five physical blocks as shown in FIG. 3A, and that each physical block has 64 heat generation elements. Therefore, each physical block can print a maximum of 64 dots as shown in FIG. 3B and the line thermal head can print 320 dots in total, as a whole. It will be assumed also that a maximum allowable number N of simultaneous power supply of heat generation elements is set to 128, and that power is supplied to all the heat generation elements in a line sequence operation of a certain line. At this time the control means combines the five physical blocks and generates three logic blocks as shown in FIG. 3C. The first logic block comprises the combination of the first physical block and the second physical block and includes 128 printing dots or in other words, 128 heat generation elements to which power must be supplied. This number is set so as not to exceed the maximum allowable number of simultaneous power supply N=128. Similarly, the second logic block comprises the combination of the third physical block and the fourth physical block and its printing dot number is 128. The third logic block comprises the remaining fifth physical block and includes 64 printing dots. Power is supplied sequentially to these three logic blocks in one line sequence operation and they effect line dot printing.

It will be asumed that when another line dot printing is carried out, the numbers of printing dots allocated to the five physical blocks are 20, 40, 10, 60 and 60 as shown in FIG. 3D. At this time the first logic block comprises the first physical block, the second physical block and the third physical block as shown in FIG. 3E and the total printing dot number is 80. This number does not exceed the set maximum allowable number of simultaneous power supply N=128. The second logic block comprises the fourth physical block and the fifth physical block and the total printing dot number is 120. This number does not exceed the maximum allowable number of simultaneous power supply N=128 supply, either.

As described above, the logic block is generated by combining a plurality of physical blocks on the basis of the printing dot number counted by each counter block within the range which does not exceed the predetermined maximum allowable number of simultaneous power supply of the heat generation elements. Power is supplied to the heat generation elements for each logic block and one line sequence dot printing is executed. Accordingly, to whichever logic block power is supplied, the printing dot number does not exceed the set maximum allowable number of simultaneous power supply.

In accordance with the present invention described above, the power supply dot number inside each physical block is counted for each dot line and the physical blocks are combined to generate logic blocks so as not to exceed the predetermined maximum power supply dot number. Power supply processing is executed for each logic block. Accordingly, a power source having a capacity which is in match with the set maximum power supply dot number can be employed, whenever desired.

What is claimed is:

1. A line thermal printer comprising:

a thermal head comprised of a plurality of physical blocks each having a plurality of heat generation elements to which power is supplied selectively for effecting dot printing on a line;

driving means having driving blocks corresponding to said physical blocks, respectively, for applying selectively the power to said heat generation elements in line sequence for each line in accordance with printing dot data;

a printing dot data memory having memory blocks corresponding to said driving blocks, respectively, for supplying the printing dot data to said driving means in synchronism with line sequence timing;

a printing dot counter having counter blocks corresponding to said memory blocks, respectively, for counting a printing dot number according to the printing dot data stored in corresponding printing dot data memory blocks for each line; and control means for controlling application of power to said heat generation elements to effect line-sequential dot printing by successively forming a logic block sum comprising a printing dot number which is counted in a first remaining counter block, including in the logic block sum a printing dot number which is counted in any next subsequent remaining counter block that does not cause the logic block sum to exceed a predetermined maximum allowable number of the heat generation elements to which the power may be applied simultaneously, while not including in the logic block sum any next remaining counter block that does cause the logic block sum to exceed the predetermined maximum allowable number so as to form a maximized logic block comprising each said counter block included in the logic block sum, forming maximized logic blocks successively by repeating said forming and including steps for all remaining counter blocks not included in one of said maximized logic blocks, and controlling the driving blocks to separately apply the power to said heat generation elements for each of said maximized logic blocks.

2. A line thermal printer according to claim 1 including a power source having a predetermined current capacity for supplying current to said driving means, and means for setting and inputting a predetermined maximum allowable number of simultaneous power supply to said control means in accordance with said predetermined current capacity.

3. A line thermal printer comprising: a plurality of heat-generating means operative when supplied with electric power for effecting dot printing on a line, the plurality of heat-generating means being divided into a plurality of physical blocks; driving means having driving blocks for selectively supplying the electric power to the heat-generating means in respective ones of the physical blocks to effect line-sequential dot printing in accordance with printing dot data applied thereto; printing dot data memory means having memory blocks for storing printing dot data for each line of print and applying the stored printing dot data to respective ones of the driving blocks; counting means having counter blocks for counting a number of printing dots in the printing dot data stored in respective ones of the memory blocks for said each line of print; and control means responsive to the number of printing dots counted by the counter blocks for separately determining and maximizing, for said each line of print, groups of the physical blocks to be simultaneously driven by forming a sum comprising a number of printing dots in a first remaining memory block, then including in the sum a number of printing dots in each subsequent next remaining memory block that does not cause the sum to exceed a predetermined maximum allowable number while not including in the sum a number of printing dots in each of the subsequent next remaining memory block that does cause the sum to exceed the predetermined number, then forming a maximized group of physical blocks comprising each memory block included in the sum, and then forming subsequent maximized groups of physical blocks by repeating the forming and including steps for each remaining memory block not yet included in one of the maximized groups of physical blocks such that a total number of the heat-generating means to be simultaneously supplied with the electric power in each one of the maximized groups of physical blocks is maximized without exceeding the predetermined maximum allowable number, the control means also controlling the driving means so that the driving blocks sequentially supply the electric power to the heat-generating means in said each one of the maximized groups of physical blocks to effect line printing.

4. A line thermal printer according to claim 3; wherein the control means includes means for grouping the physical blocks into logic blocks according to the printing dot numbers counted by the counter blocks such that a total number of said heat-generating means in each of said logic blocks does not exceed the predetermined maximum allowable number.

5. A line thermal printer according to claim 4; including means for inputting to the control means a desired predetermined maximum allowable number.

6. A line thermal printer according to claim 4; including a power source having a predetermined current capacity and being connected to supply electric current to the driving means; and means for inputting to the control means a desired predetermined maximum allowable number based on the predetermined current capacity.

7. A line thermal printer according to claim 3; including means for inputting to the control means a desired predetermined maximum allowable number.

8. A line thermal printer according to claim 3; including a power source having a predetermined current capacity and being connected to supply electric current to the driving means; and means for inputting to the control means a desired predetermined maximum allowable number based on the predetermined current capacity.

9. In a line thermal printer having a line thermal head comprised of a plurality of physical blocks each having a plurality of heat generation elements to which power is applied selectively for effecting dot printing on a line, driving means having driving blocks corresponding to said physical blocks, respectively, for selectively applying power the to said heat generation elements in line sequence for each line in accordance with printing dot data, a printing dot data memory having memory blocks corresponding to said driving blocks, respectively, for supplying the printing dot data to said driving means in synchronism with line sequence timing, and a printing dot counter having counter blocks corresponding to said memory blocks, respectively, for counting a printing dot number depending on the printing dot data stored in corresponding printing dot data memory blocks for each line, a method for controlling the application of power to the heat generation elements, comprising the steps of:

combining a plurality of the physical blocks of the line thermal head to form logic blocks according to the printing dot number counted by the counter blocks such that a total number of the heat generation elements to be simultaneously applied with the power by the driving means in each of said logic blocks is maximized without exceeding a pre-determined maximum allowable number, the step of combining said plurality of physical blocks of the line thermal head to form each of said logic blocks comprising the sub-steps of providing the printing dot data to each of the memory blocks of the printing dot data memory, counting the printing dot number for each of said counter blocks of the printing dot counter depending on the printing dot data stored in each memory block to form a subtotal of printing dots for each counter block, adding a sub-total of printing dots in a first counter block to a sub-total of printing dots in a second counter block to obtain a sum, determining whether the sum exceeds the predetermined maximum allowable number of said heat generation elements to be simultaneously applied with the power, maximizing the sum to form a first logic block by repeating the adding and determining steps for each subsequent counter block, while not including in the sum any subsequent counter block determined to cause the sum to exceed the maximum allowable number, such that the total number of said heat generation elements to be simultaneously applied with power in the first logic block is maximized without exceeding the predetermined allowable number, and then repeating the adding, determining and maximizing steps for any counter blocks remaining after said formation of the first logic block so as to obtain subsequent maximized sums in order to form subsequent said logic blocks; and applying the power to the heat generation elements of each of said logic blocks sequentially.

10. A method for controlling an application of driving power to heat generation elements of a line thermal printer head, comprising:

combining a plurality of physical blocks of a line thermal printer head to form logic blocks based on a number of dots to be printed on a line as determined by a plurality of counter blocks which correspond to the physical blocks, such that a total number of said heat generation elements to be simultaneously driven with power in each of said logic blocks is maximized without exceeding a predetermined highest allowable number, the step of combining the plurality of physical blocks of the line thermal printer head to form said logic blocks comprising the sub-steps of (a) determining a number of said heat generation elements to be driven in each of the plurality of physical blocks for a line of print, (b) adding a determined number of said heat generation elements in a first remaining physical block to a determined number of said heat generation elements in a next remaining physical block to form a sum, (c) comparing the sum to the predetermined highest allowable number, (d) if the sum exceeds the highest allowable number, then adding the determined number of heat generation elements in the first remaining physical block to a determined number of said heat generation elements for a subsequent next remaining physical block to form the sum, (e) if the sum does not exceed the highest allowable number, then adding a determined number of said heat generation elements of each subsequent next remaining physical block that does not cause the sum to exceed the highest allowable number to the sum, while not including a determined number of said heat generation elements of any subsequent remaining physical block that causes the sum to exceed the highest allowable number, (f) then forming a logic block including each physical block contained in the sum so that a total number of determined number of said heat generation elements in the logic block does not exceed the highest allowable number, and then (g) repeating steps (b), (c), (d) (e) and (f) for each said remaining physical block not yet included in one of said logic blocks so as to form said plurality of logic blocks, each comprising a number of said heat generation elements that does not exceed the highest allowable number; and applying the driving power to the heat generation elements of each of said formed logic blocks sequentially.

11. A method of controlling application of driving power to heat generation elements of a line thermal printer head, comprising the steps of:

(a) dividing a line thermal printer head into a plurality of physical blocks, each of the physical blocks having a predetermined number of said heat generation elements;

(b) determining a number of said heat generation elements to be driven in each of the plurality of physical blocks for a line of print;

(c) adding a determined number of said heat generation elements in a first remaining physical block to a determined number of said heat generation elements in a next remaining physical block to form a sum;

(d) comparing the sum to a predetermined highest allowable number;

(e) if the sum exceeds the highest allowable number, then adding the determined number of said heat generation elements in the first remaining physical block to a determined number of said heat generation elements for a subsequent next remaining physical block to form the sum;

(f) if the sum does not exceed the highest allowable number, then adding a determined number of said heat generation elements of each subsequent remaining next physical block that does not cause the sum to exceed the highest allowable number to the sum to form the sum, while not including in the sum the determined number of said heat generation elements of said each subsequent remaining next physical block that causes the sum to exceed the predetermined number; and (g) then forming a logic block comprised of each physical block contained in the sum so that a total number of determined number of said heat generation elements in the logic block does not exceed the highest allowable number.

12. A method of controlling the application of driving power to heat generation elements of line thermal printer head according to claim 11; further comprising the step of forming subsequent logical blocks by repeating steps (c) through (g) for any remaining physical blocks not a part of said logic block.

13. A method of controlling the application of driving power to heat generation elements of a line thermal printer head according to claim 12; further comprising the step of separately applying the driving power to said heat generation elements of said each formed logic block.

14. A method of controlling the application of driving power to heat generation elements of a line thermal printer head according to claim 11; further comprising the step of separately applying the driving power to said heat generation elements of the formed logic block and any remaining physical block not included in the formed logic block.

* * * * *